US009222322B2

(12) United States Patent
Brandsdal

(10) Patent No.: US 9,222,322 B2
(45) Date of Patent: Dec. 29, 2015

(54) PLUG CONSTRUCTION COMPRISING A HYDRAULIC CRUSHING BODY

(75) Inventor: Viggo Brandsdal, Ytre Arna (NO)

(73) Assignee: TCO AS, Bergen (NO)

( * ) Notice: Subject to any disclaimer, the term of this patent is extended or adjusted under 35 U.S.C. 154(b) by 542 days.

(21) Appl. No.: 12/735,907

(22) PCT Filed: Apr. 8, 2009

(86) PCT No.: PCT/NO2009/000138

§ 371 (c)(1),
(2), (4) Date: Aug. 25, 2010

(87) PCT Pub. No.: WO2009/126049

PCT Pub. Date: Oct. 15, 2009

(65) Prior Publication Data

US 2011/0000676 A1 Jan. 6, 2011

(30) Foreign Application Priority Data

Apr. 8, 2008 (NO) ..... 20081735

(51) Int. Cl.
*E21B 33/12* (2006.01)
*E21B 29/00* (2006.01)

(52) U.S. Cl.
CPC ..... *E21B 29/00* (2013.01); *E21B 33/12* (2013.01)

(58) Field of Classification Search
USPC ..... 166/317, 376, 192, 179; 138/93
See application file for complete search history.

(56) References Cited

U.S. PATENT DOCUMENTS 1,912,458 A * 6/1933 Mapes ..... 169/11
5,607,017 A * 3/1997 Owens et al. ..... 166/288

FOREIGN PATENT DOCUMENTS

WO WO 2007108701 A1 * 9/2007 ..... E21B 33/12
WO WO 2008127126 A2 * 10/2008 ..... E21B 33/12

* cited by examiner

*Primary Examiner* — David Bagnell
*Assistant Examiner* — Ronald Runyan
(74) *Attorney, Agent, or Firm* — Francis C. Hand; Carella, Byrne, et al

(57) ABSTRACT

A plug element for conducting tests of a well, a pipe or the like, comprising one or more plug bodies of disintegratable/crushable material set up to be ruptured by internally applied effects, is disclosed. The plug element of the invention comprises an internal hollow space set up to fluid communicate with an external pressure providing body, and the plug is designed to be blown apart by the supply of a fluid to the internal hollow space so that the pressure in the hollow space exceeds an external pressure to a level at which the plug is blown apart.

16 Claims, 14 Drawing Sheets

PRIOR ART

PLUG CONSTRUCTION COMPRISING A HYDRAULIC CRUSHING BODY

The present patent application relates to a plug construction comprising a hydraulic crushing body as given in the preamble of the subsequent claim 1.

BACKGROUND TO THE INVENTION

To use explosive charges to remove plugs that have been temporarily placed to close off a well, a drill hole or the like, is well known. As a rule, such an explosive charge is either placed on top of the inserted plug, but it can also in some cases be placed in the centre of the plug. Today many different mechanisms are used to trigger such explosive charges.

Today's systems with explosive charges leave behind unwanted residues and also the explosive charges constitute a potential risk for the user in the handling of the plug.

Also well known are solutions where one goes down into the well itself and crushes such plugs with mechanical effects, blows or drilling which do not involve explosive charges.

Also known is a solution where individual plug bodies are mounted in their separate seat in the plug, for example as disclosed in the International patent publication WO 2007/108701 (Bjoergum Mekaniske).

This solution is based on a non-compressible fluid being filled between each plug body which at a signal for opening is drained out into a separate atmospheric chamber. By draining this fluid out into the atmospheric chamber the plug elements shall collapse with the help of the hydrostatic pressure. However, if there is a leak in the atmospheric chamber, this would not function as the fluid can not be drained. Another disadvantage with this solution is that the plug construction must be weaker than one wants as it requires that the different plug bodies must be thin enough to rupture with the help of the well pressure only.

The aim of the present invention is to provide a method for removal of the plug without the use of explosives and which does not have the disadvantages described above.

Furthermore it is an aim of the invention to avoid the limitations which today's solutions without explosives place with regard to the plug construction, such as the thickness of the plug element and the risk of damage to the well formation with the opening under pressure higher than the hydrostatic pressure in the well.

SUMMARY OF THE INVENTION

The plug for carrying out tests of a well, a pipe or the like, is comprised of one or more plug bodies of a material able to disintegrate or crush, set up to rupture by an internally supplied effect, is characterised in that the plug comprises an internal hollow space designed to be in fluid connection with an external pressure exerting body, and the plug is set up to be blown apart by the supply of fluid to the internal hollow space so that the pressure in the hollow space exceeds an external pressure to a level so that the plug is blown apart.

It is preferred that the plug is composed of one or more elements, i.e. two or more plug layers the one placed on top of the other. This composite plug element is then pressurised in the internal volume with the help of preferably an axially arranged circular piston which is released by a release mechanism.

The pressure which is created by this piston is preferably much higher than the well pressure and the plug will rupture as a consequence of the internal pressure.

This piston preferably functions in an integrated chamber in the wall section of the plug. This piston preferably has a larger piston area on the well side than on the side which pressurises the inner volume of the plug element.

This piston element is preferably inserted in the plug wall and held in place by a casing which also holds the plug element in place.

The plug elements have preferably a plane surface towards the well side and a gentle arch shape (concavity) is ground out towards the centre of the plug.

This weakness which the arch constitutes against pressure from the inside will preferably be of such type that one can control which of the plug elements which shall be ruptured.

It is also preferred that one can vary the thickness of the plug elements to have the same control over which plug element shall rupture when the plug is pressurised from the inside.

So called "squibs" (pyrotechnical units also found in airbags) can preferably be used which are electrically triggered to create the increased internal pressure which is required to crush/fracture the plug elements.

In a preferred embodiment, pre-compressed gas is used to drive a piston as described earlier. Alternatively, the compressed gas can be under pressure which in itself provides an effect large enough to crush and fracture the plug element when it is released directly into the controlled internal volume.

When such a system with hydraulic crushing is applied one avoids the problems of explosives and the associated safety risk. Also avoided are the remains of the housings of the explosives in the well. This will constitute a considerable improvement to be able to provide crushable plugs to all types of wells.

It is essential that the crushing occurs from a space or a volume established internal in the centre of the plug as this is a volume that can be controlled and pressurised to a much higher level than the rest of the pipe in which the plug is fitted. In testing, hydraulic crushing from the centre space provided very good results for glass and ceramic plugs.

The crushing system can be constructed so that it requires very little of the internal diameter (ID) of the plug and thus a good OD/ID ratio can be obtained. OD is a term for the external diameter. It is possible to make plugs with hydraulic crushing with a large ID without explosives for the crushing, something which is not possible today. Thereby, it is a considerable advantage to remove the explosive charges from the present systems, and replace them by a system that crushes the plug without use of these explosive charges.

A good effect is obtained in particular with glass and ceramic materials. These materials can be formed so that they can withstand a high pressure from one side and a low pressure from the other side. This is not problematic with respect to the strength of the plug as it will be crushed from the inside and after crushing of a body the remaining parts do not withstand much pressure before they rupture and these will then be easy to crush at a relatively low pressure from the well fluid.

The system will also be far cheaper to produce in that the expensive component which the explosives represent is omitted. As a consequence, transport and logistics will also be much simpler.

DETAILED DESCRIPTION OF THE INVENTION

The solution according to the present invention functions in that a liquid fluid under a pressure is let into a hollow space between the different plug bodies or plug discs. Alternatively, this fluid under pressure is let into an adapted hollow space in an individual or single plug body. This pressure of the fluid can be provided via a hydraulic piston which works in a boring in the axial direction through the plug sleeve in that a pre-compressed gas in an accumulator chamber is released.

Alternatively, a pyrotechnic unit can be started to give a suitable strong pressure pulse to crush the plug element.

The hollow space is safeguarded with the help of gaskets protected against fluid pressure influences from the well side and the top side of the plug against pressure influences from the pump test operations from the rig. These gaskets are made so that they can withstand much higher fluid pressure than the plug bodies themselves. Thus, the fluid under pressure which shall be let in will only escape by crushing one or more plug bodies.

This pressure of the fluid can be created as the axially orientated piston is set up in a casing and has such a shape that the piston area is larger on the side of the plug that can be pressurised from either the well side of the plug or from the top side of the plug via a valve. The reduced piston area which functions against the internal hollow space of the plug bodies that are filled with a liquid when the hollow space is pressurised, will get an increased pressure in relation to the top side or the bottom side of the plug because of this area difference.

This increased fluid pressure creates a pressure difference between the internal pressure in between the plug bodies (discs) and the hydrostatic pressure on top of the plug bodies and also against the well pressure. When the plug bodies rupture as a consequence of this fluid pressure difference, it is possible with the help of fluid pressure from the rig applied to the top of the plug to rupture any plug bodies that are still intact as the plug body alone is not strong enough to withstand the maximum fluid pressure of the pipe in which the plug is fitted.

The number and thickness of the plug bodies placed one on top the other, are adjusted so that they can not withstand the maximum fluid pressure of the pipe as a single body. For plugs where an internal volume is constructed for crushing of an individual plug body, this internal volume of the plug body will be adapted so that the plug can withstand the maximum pressure from the top side and bottom side of the plug, but not from the inside. This can be achieved, for example, by grinding to form an internal roman bridge which brings the load force from externally supplied pressure out towards the outer edge of the plug body and thereby withstand pressure form the outside.

In this embodiment there is only one plug body and when this is crushed any residual parts of the plug can easily be forced out.

The movement of the piston is released by either an electric signal, ultrasound, acoustic signals or hydraulic pulses in a well which is received by a mechanical or electrical system.

The present solution also leads to a good solution with regard to the contingency opening of the plug as it does not contain explosives that can get lost.

In an alternative embodiment the gas can be compressed in advance to a given pressure so that this gas is released either directly into the hollow space in the plug or in at the top of the piston so that the required pressure is reached.

The desired pressure can also be created by electrically or mechanically starting a squib which is in connection with the hollow space between the plug bodies and will thereby increase the pressure to the level where at least one of the plug bodies rupture. The created hydraulic pressure from the squib can be used in the same way as for the gas, either directly into the hollow space or via a piston which can further increase the pressure.

With the present solution with explosives, there is always a risk that explosives can be left live (undetonated) in the well after use of "contingency". Such plugs where explosives lie inside the plug material are thus a problem today and are not acceptable for the user, even if this risk is relatively small.

With the present solutions with several plug elements arranged on top of each other and liquid in between the elements the corresponding crushing effect can be obtained without the use of explosives.

This solution is based on the controlled liquid in between the plug elements not being able to be compressed and through this the uppermost plug element will get help to take the axial load in the system of the below-lying elements.

The disadvantage with this system is that it is subjected to potential damages in the upper plug element when the other elements are dropped into the well, as the uppermost plug element can not withstand a large mechanical load alone and is easily crushed. As a consequence, the plug will open up without control and at a wrong time. Furthermore, this system leads to a risk for possible leaks of liquid out between the plug elements something which will also lead to a premature opening of the plug.

In order to ensure that the plug ruptures after the liquid between the elements has drained out in a controlled fashion, the plug elements have to be so thick that they are crushed at moderate pressures. Such a solution is unwanted. Glass, which is a material of current interest, has a recommended safety factor of 3, something which can lead to that the plug does not crush in unfortunate situations at the low pressures one operates at after an opening of the plug.

The term "safety factor 3" means that a glass plug constructed for a differential pressure of 345 bar will need to withstand a pressure of up to three times said differential pressure, i.e. 345×3=1035 bar to maintain recommended safety factor for glass.

Another disadvantage is that the fluid pressure must be increased in the well after the opening system of the plug is activated. This can lead to a risk of damage of the reservoir when the plug collapses under higher pressure than the hydrostatic pressure in the well.

The invention shall now be explained in more detail with reference to the enclosed figures, in which.

Figure 1:
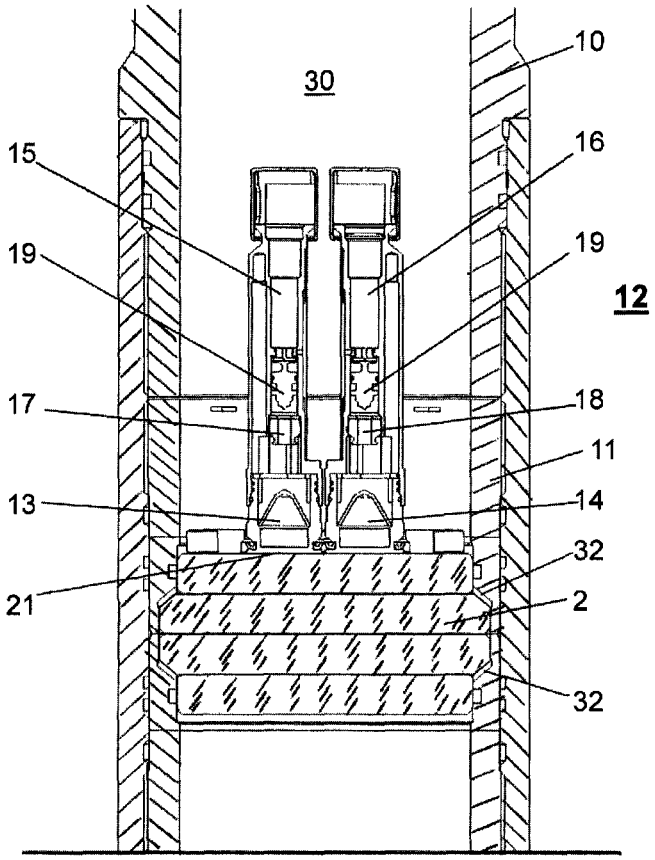
FIG. 1 shows a typical known solution with explosives, according to the state of art.

Initially, reference is made to FIG. 1 which illustrates a typical known solution where a plug 2 is fitted inside a pipe section 11 which is inserted in a production pipe 10 in the well 30 that runs through a formation 12 in an oil/gas containing formation. The explosive elements in the form of two column-formed bodies 15,16 are placed on the top side 21 of the crushable plug 2 (glass, ceramics or the like).

The plug 2, hereafter only termed a glass plug, is inserted in the well 30 to carry out pressure testing of the well to control that all parts are sufficiently leak proof and can hold a given pressure of fluid.

When these tests have been carried out, the plug 2 is removed in that it is exploded with the two explosive charges 13,14. The explosion can take place in many ways. A normal way is that well fluid, with a given pressure, is let into the inner parts of the explosive charge housing 15,16 so that an ignition pin 19 is pushed down and hits an igniter 17,18 which initiates the ignition of the underlying explosive charge 13,14. The glass is thus burst into a fine dust that does not cause any damage in the well. The column formed bodies 15,16 themselves are also exploded into small fragments. Explosion elements of the type shown in FIG. 1, leave several larger fragments in the fluid stream (termed debris) which are not wanted. The explosive elements of the type shown in FIG. 1, still lead to a number of larger fragments or debris above a certain size and is unwanted.

The plug is inserted in the well to temporarily close the fluid flow through the well, such as during pressure testing of the well, to ensure that all parts thereof are sufficiently leak proof and can retain a given pressure.

The above considerations are not required to be made in the solution (not shown) when the explosives are placed in the centre of the plug element, but this also has all the disadvantages with possibilities for residues after explosives and also transportation problems and otherwise the risks of handling that are associated with the use of explosives.

It is an aim of the invention to provide a solution where the plug is crushed without the need for explosives and also to avoid the limitations which today's solutions without explosives place on such things as thickness of the plug element and danger of damage to the well formation at the opening under higher pressure than the hydrostatic pressure in the well.

The present invention is characterised in that a plug body has an internal hollow space which can be pressurised to an internal pressure, which internal pressure one or more plug bodies that the main plug body, can not withstand, so that a crushing/pulverization of the plug occurs.

Figure 2:
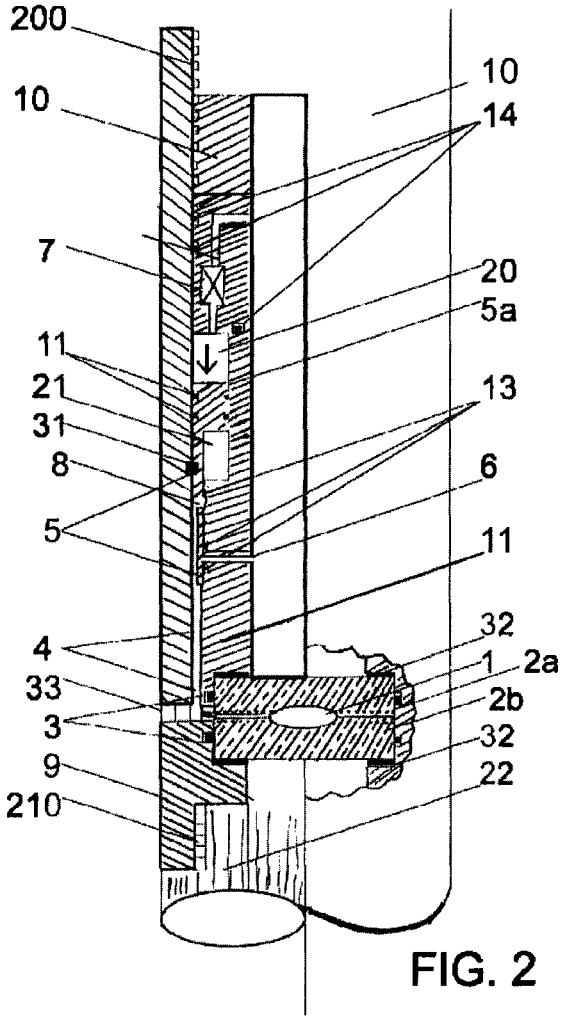
FIG. 2 shows an embodiment of the present invention of a plug element 2 in its normal position, i.e. not released or opened.

FIG. 2 shows a preferred embodiment of the invention. The plug body 2 is preferably as circular shaped disc and constitutes a part of a pipe section 22 including upper and lower threaded connections 200 and 210, respectively, to be inserted in between upper and lower production pipe sections (not shown on the figures). The circular plug body 2 (a ceramic or glass element) is arranged in a seat 32 in the pipe section 22, and its purpose is to close off the fluid passage through the hollow pipe sections. The plug body 2, is composed of two plug sections 2*a*,2*b*, the one 2*a* placed on top of the other 2*b*. The plug body 2*a*,2*b* surfaces facing each other defines a hollow space 1 which may be formed by said surfaces defining concavities. Packing elements 3 (e.g. O-rings) seals off the passage between the plug body and the pipe section 2.

The hollow space 1 communicates with the pipe fluid passage via a system of channels 20,21,4 designed in the wall of the pipe section 22. The channel system passes downward as a boring 4 which is in connection with the hollow space 1. A hydraulic operated elongated piston 5 is arranged in the channel downstream of a valve 7, and is held in place by shear pin 31. Thus the glass plug body 2*a*,2*b* is protected against unintentional rupturing due to normal pressure fluctuations in the channel system.

The valve 7 is arranged to open for fluid pressure into a hollow space 20 in such a way that the piston area in the annular space 20 which is pressurised via a valve 7, is larger than the area of the boring/annular space 4. The valve is arranged to open for fluid flow by a signal. Then the shear pin 31 breaks and the piston 5 is forced downwardly thus increasing the fluid pressure through the fluid channel 4 and further increasing pressure into the hollow space 1 of the glass plug body 2*a*,2*b* and starting the crushing process removing the glass plug body 2. The upper portion 5*a* of the piston 5 (FIG. 2), is a wider section arranged to move axially in an expanded section 20,21 of the channel section defined in the pipe wall.

The present invention is characterised in that the fluid pressure in the hollow space 1 and the boring 4 which is in connection with the hollow space 1 is provided by means of a hydraulic piston which is arranged in a horizontally set up casing in the plug body (or housing) 9 in such a way that the piston area in the annular space 20 which is pressurised via a valve 7, is larger than the area of the boring/annular space 4. Thus, one obtains that when the annular space 20 is pressurised, a difference arises between the pressure in the chamber/annular space 4 and 20. As a consequence of the area difference of piston 5, the fluid pressure in the boring/annular space 4 will be higher than the supplied fluid pressure in the annular space 20.

A premise is that the annular space 20 has either atmospheric pressure or is drained out into an accumulator (accumulator chamber not shown).

According to the invention, it is preferred that the piston 5 is powered by the hydraulic pressure of the well. Alternatively, this can, for example, be replaced by compressed gas. According to the invention, it is also preferred that the piston 5 is set up horizontally in the casing 30. In an alternative embodiment, several borings are provided to a number of pistons which influence several gates in towards the hollow space 1. These pistons can be moved inwards or outwards from the center line of the plug 2 according to need.

In the FIGS. 2 to 12, longitudinal vertical sections of the present invention are shown.

FIG. 2 shows that the piston 5 is held in place in the upper part of a pipe section 11 by a shear pin 1. The casing 5 also holds the plug body 2 in its seats 32. The pipe section 11 is held in place in a plug 9 by a nut. Below piston 2 which works in the slit that is formed by the hollow spaces 20,21 and 4 between the plug body 9 and pipe section 11 is a chamber/boring 4 in connection with a hollow space 1 in the plug body 2 (i.e. the two plug sections 2*a* and 2*b* as shown).

The length or extent of the pipe section 11 of the invention is indicated (see also FIG. 13 in this regard) by the lower and upper threaded connections 200 and 210, respectively, the pipe section 11 being inserted in between upper and lower production pipe sections.

When the valve 7 opens for fluid pressure into the hollow space 20, the piston 5 moves axially downwards and creates a higher pressure in the hollow space 4 and which is transferred to the hollow space 1. The axial movement of the piston 5 which travels downwards occurs because the annular space 21 is pressurised atmospherically. This extra pressure in the hollow space 1 leads to the plug bodies being blown apart hydraulically. If required, a calibrated pressure can be pressurised in advance in the hollow space 1 through a plugged gate 33 in the plug body 9 by installing special tools for this in the gate 33 (tool not shown). This pressure which is installed in advance must lie below the rupturing pressure of the plug body 2. The higher pressure which is created when piston 5 moves downwards can only be released by crushing the plug body 2, as the plug body 2 has a high-pressure seals 3 which can withstand the pressure and will not yield to the pressure before the plug body 2 ruptures.

Figure 3:
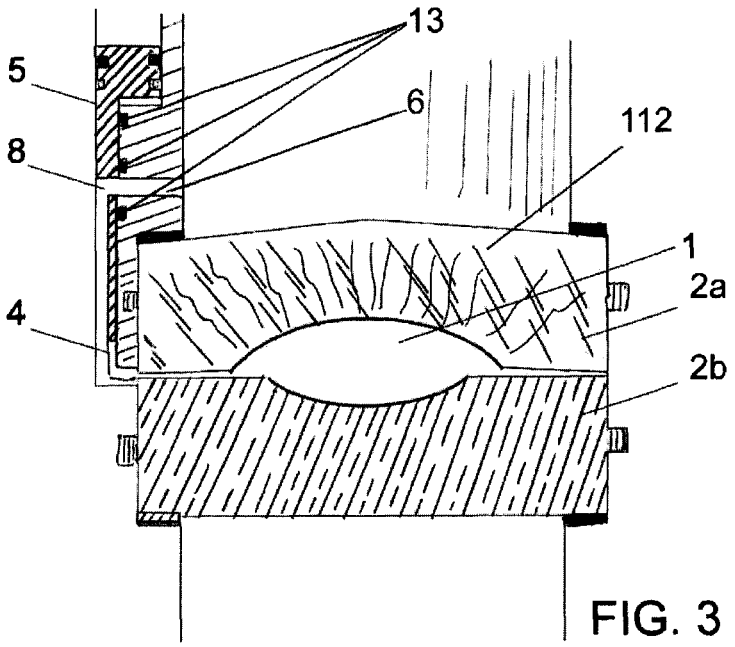
FIG. 3 shows a lower part of the present invention in section in released position with rupture formations in the top side glass disc of the plug body.

Referring to FIGS. 2 and 3, the lower part of the piston 5 includes a radially directed bore 8 which is to be positioned in line with a second bore 6 in the pipe section 11.

In FIG. 3, piston 5 is activated and the hydraulic pressure in the hollow space 1 has ruptured the upper plug body 2, indicated by the lines 112. The piston 5 has also opened for pressure in from boring 6, as boring 8 in the piston 5 is now in line with the boring 6. The boring 6 which can be one or more borings in the pipe section 11 in towards the circular piston 5 has a task of easing the through-flow of the pressure into the hollow space 1 to ensure that the remaining lower plug body 2 experiences (is subjected to) the whole of the pressure difference when the upper part of the plug is pressurised from the rig. The plug body 2*b* will not be able to withstand the pressure difference that arises between the top and the bottom of the plug on its own. Thereafter the plug body will rupture and the plug will be open for flow of fluid from the well.

Figure 4:
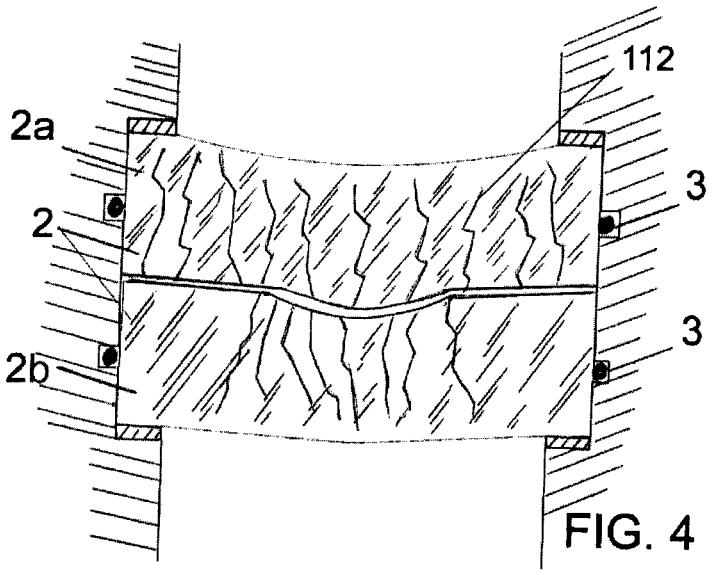
FIG. 4 shows a lower part of the present invention in section in released position where the upper plug body is ruptured and starts collapsing and the lower plug body is about to collapse as it can not withstand the pressure alone.

In FIG. 4 both the plug bodies 2*a* and 2*b* are about to be crushed as a consequence of the supplied hydraulic pressure, first through the axial movement of piston 5, thereafter through emigration of pressure through the plug body 2*a* that first ruptures in to the hollow space 1 which now subjects the remaining plug body 2*b* to such high pressure that this also ruptures.

Figure 5:
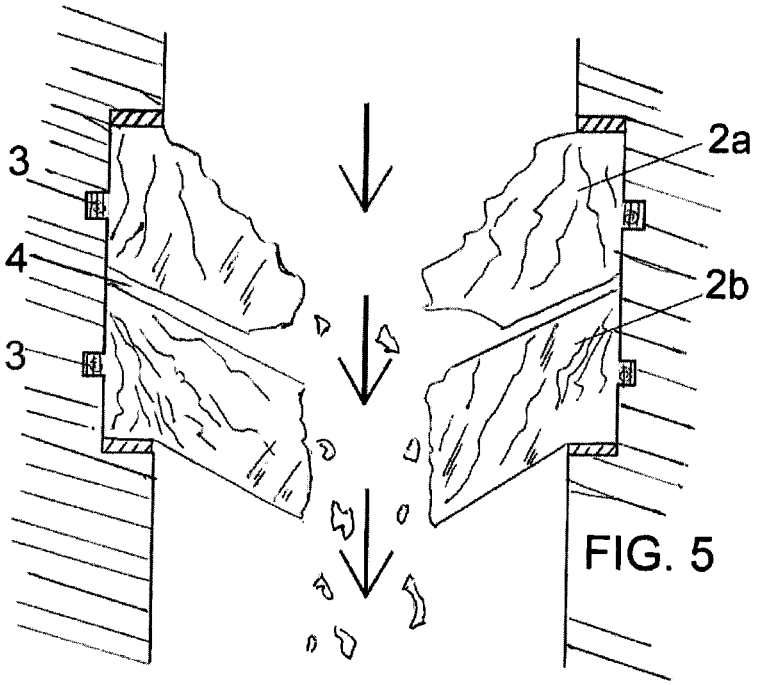
FIG. 5 shows the present invention where both an upper and a lower plug body are ruptured and the through-flow of pipe fluid is about to wash out the remains of the two plug bodies.

In FIG. 5 both the plug bodies 2*a*,2*b* are ruptured and the well pressure is about to wash out the residual parts of the plug body 2.

Figure 6:
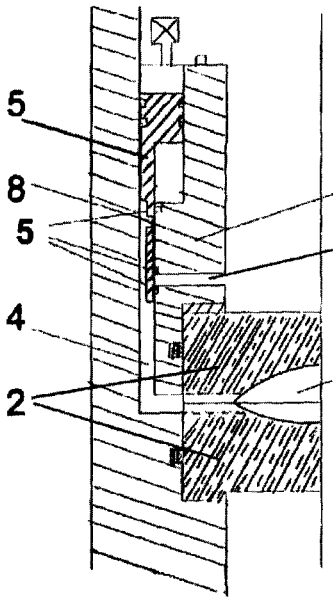
FIG. 6 shows an enlarged detailed section of the lower part of the present invention in normal position.

FIG. 6 shows a detailed illustration of FIG. 2 with the piston 5 in an upper, inactivated position.

Figure 7:
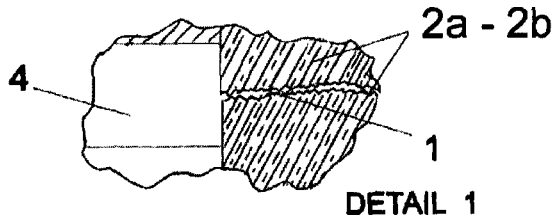
FIG. 7 shows the present invention with an alternative embodiment of the plug bodies. The internal hollow space only consists of natural differences in the surface contour of the opposite plug surfaces making a slit between the surfaces, shown by the term DETAIL 1 in the figure.
Figure 7:
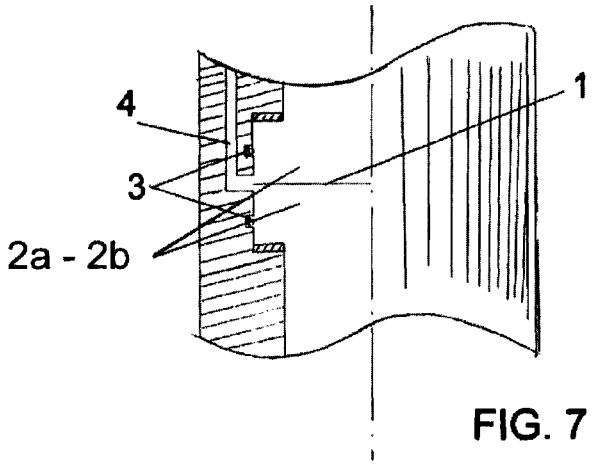

FIG. 7 shows an alternative embodiment of the device where the hollow space 1 is made up of the mutually natural irregular differences of the plug bodies 2 is shown in DETAIL 1.

Figure 8:
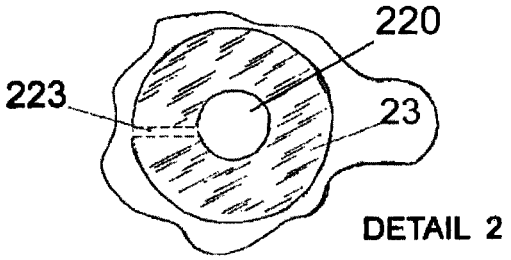
FIG. 8 shows an example of the present invention with an alternative embodiment section and DETAIL 2 in the figure where an extra body is placed between the two plug bodies to form the hollow space between the plug bodies.
Figure 8:
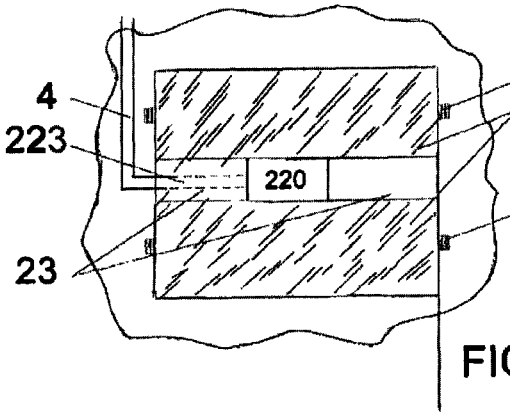

FIG. 8 shows an alternative embodiment. Instead of creating a hollow space 1 in the plug body 2, an intermediate body 23 is inserted that creates this hollow space 1 between the two sections of the plug body 2. A circular disc to be used for this purpose is shown in see DETAIL 2. As shown in detail 2, this body is a ring shaped disc 23 including a duct 223 communicating between the axial shaped fluid channel 4 and the internal space 220.

Figure 9:
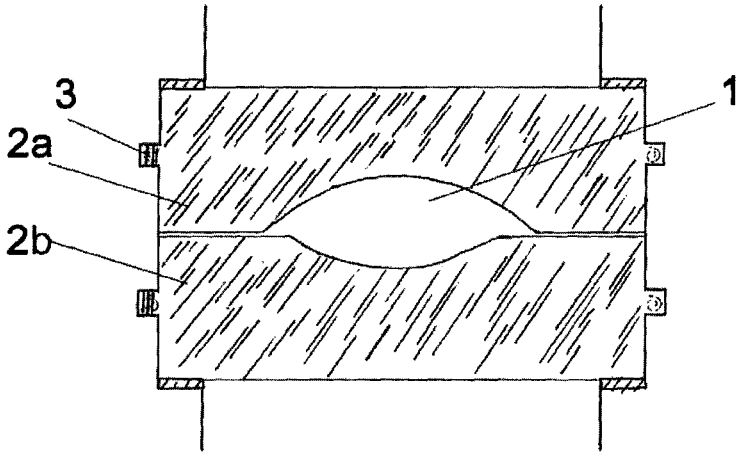
FIG. 9 shows the present invention with clear larger weaknesses arranged on one of the plug bodies 2*b* to control which body will rupture.

FIG. 9 shows details of the plug body 2 when larger hollow concave shaped recesses or spaces are formed in the surface of the plug body section 2*a* than in section 2*b* so that one can control which body section will rupture first.

Alternatively, there can be other embodiment forms of controlled rupturing, for example, by varying the thickness of the plug bodies 2*a* and 2*b*.

Figure 10:
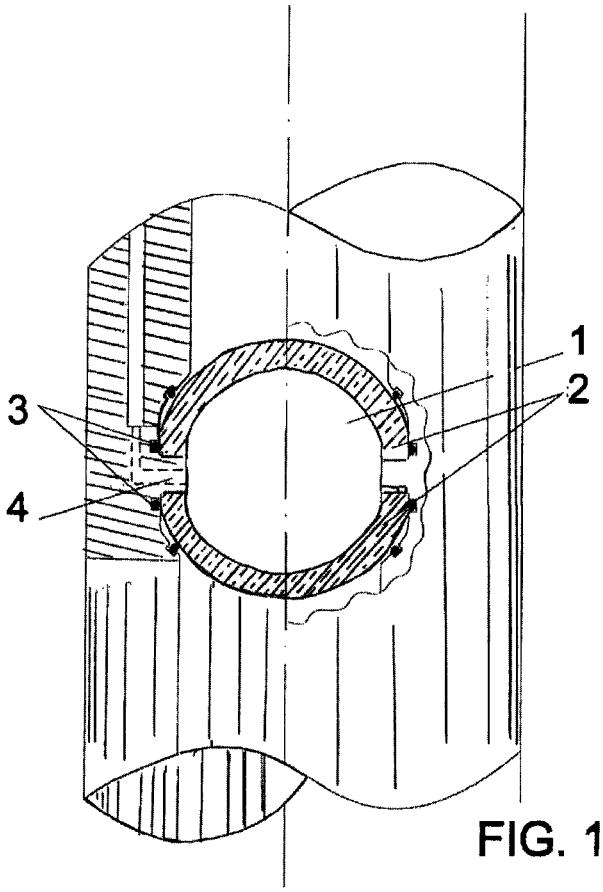
FIG. 10 shows an alternative embodiment of the plug bodies carried out as two half-balls placed against each other so that they form two domes inside the pipe towards the pressure sides.

FIG. 10 shows an alternative embodiment of the plug body 2 which can be used and be ruptured with the help of applied internal hydraulic pressure. This is a variant which can externally withstand a pressure difference of typically 10, 000 psi and internally to the outside can only withstand 1500 psi. In such an embodiment it is therefore easy to rupture the bottom plug body by pumping the fluid pressure up to 345 bar at the top side. In this embodiment, the plug body sections are formed as two domes that are placed facing each other.

Figure 11:
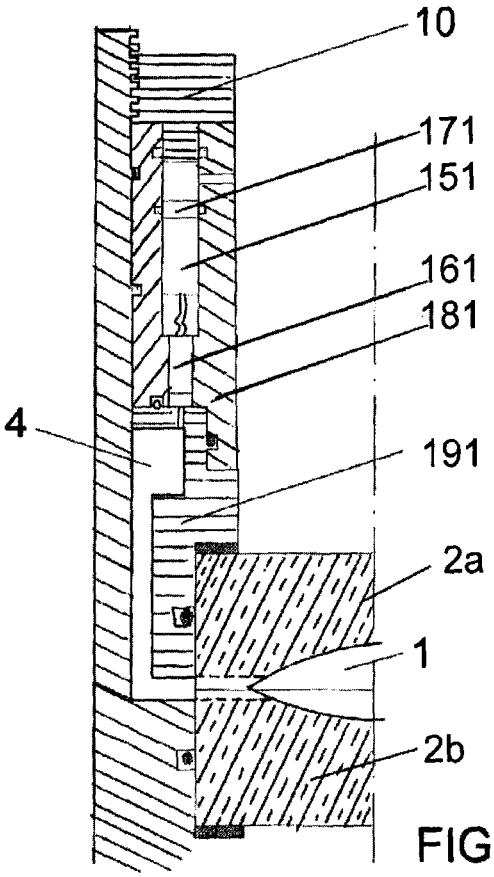
FIG. 11 shows the present invention with an alternative method to provide a desired internal pressure with the help of one or more pyrotechnical elements.

FIG. 11 shows an alternative method to provide a desired pressure in the hollow space 1 by starting or detonating a pyrotechnical unit 161 electrically via an electronic part which is in connection with a pressure sensor 171 or a timer function built into the electronic part 151. This system is also built into the casing 48 as the pipe section 11 is now replaced by two smaller pipe section units 181 and 191.

Figure 12:
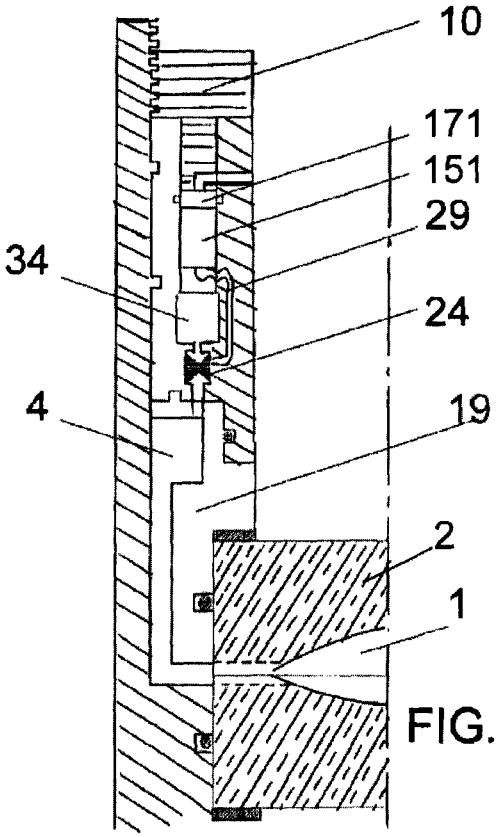
FIG. 12 shows the present invention with an alternative method to provide the desired internal pressure with the help of a gas in an accumulator which is compressed in advance.

FIG. 12 shows an alternative method to provide the necessary pressure (for the rupture of the plug) by accumulating the fluid pressure in advance in a pressurised accumulator chamber 24 which is electrically connected via a cable 29 to the electronic part 151 and pressure sensor part 171. Here, the annular space 4 is also in connection with the hollow space 1 inside the plug body 2.

Figure 13:
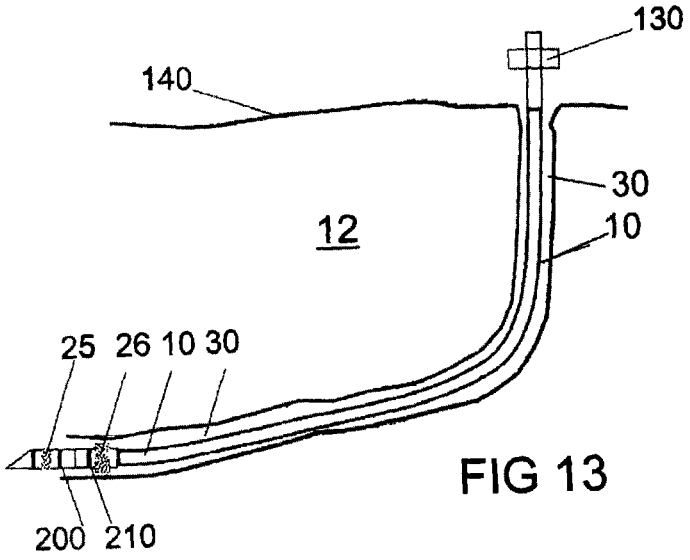
FIG. 13 shows a typical application area for such a test plug of the present invention.

FIG. 13 shows a typical application area for a plug of this type.

A hydrocarbon formation 12 is penetrated by a well 30 to bring the hydrocarbons to the surface 140 for further utilization. An installation to handle the hydrocarbons at the surface is shown at 130. A hydrocarbon production pipe 10 is arranged through the well 30. The end section of the production pipe 10 may optionally be closed by a blind plug 25. After the pressure testing has ceased the pipe 10 may be perforated adjacent to the hydrocarbon containing formation or formations 12, in order to allow for in-flow of hydrocarbons into the production pipe 10.

The plug 25 is fitted at the end of the pipe 10 where a gasket 26 seals the space between the production pipe 10 and the external wall of the well 30. Thereby, pipe 10 can be pressure tested against the test plug 25. After the pressure testing of pipe 10 and its upper components has been conducted, plug 25 can be opened by sending in, for example, signals to an opening system fitted into the plug 25. The signal can, for example, be hydraulic pressure pulses, an electric signal, an acoustic signal or ultrasound.

Figure 14:
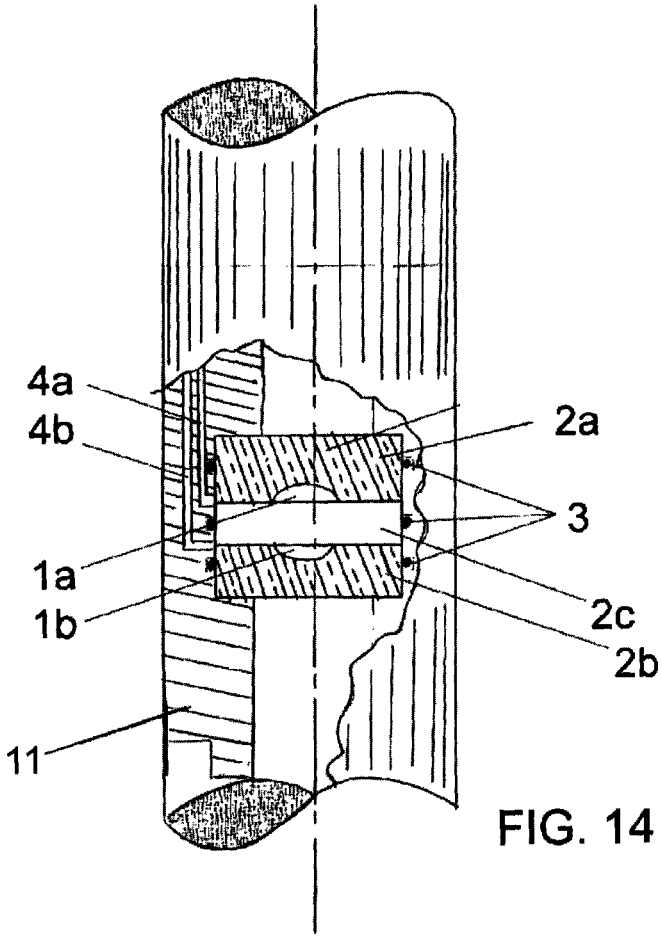
FIG. 14 shows an embodiment of the present invention where there are more than two plug bodies, in this case three. The number can be increased to a desired collective strength of the plug.

FIG. 14 shows an alternative embodiment where three plug body sections 2*a*, 2*b*, 2*c* are arranged, one placed on top of the other, to obtain sufficient strength of a plug. The hollow spaces 1*a* and 1*b* between the plug body sections 2*a* and 2*b* and 2*c*, respectively, can be fluid pressurised separately through separate channels 4*a* and 4*b* to obtain the required order of crushing of the plug bodies. By pressurizing the hollow spaces 1*a* and 1*b* separately via either two or more piston 5 devices placed in a row vertically in the internal casing 11, it is ensured that the plug body sections 2*a* and 2*b* are ruptured in a controlled way from the inside as they will now be subjected to large differential fluid pressure loads against the respective outsides of the plug body sections 2*a* and 2*b*. Only the single plug body section 2*c* is left in the centre of the plug after activating the opening mechanism. However, the remaining body section 2*c* is not strong enough to withstand the well fluid pressure on its own and the plug collapses.

With the present invention, a considerable technical step forward has been made in this area which relates to test plugs in a disintegrate able/crushable material.

The invention claimed is:

1. Plug element for conducting tests of a well ruptured, or a pipe, comprising at least one plug body of disintegratable/crushable material set up to be ruptured by internally applied effects, characterised in that said one plug body comprises at least two plug sections defining an internal hollow space therebetween set up to fluid communicate with an external pressure providing body, and at least one of said plug sections is designed to be blown apart by the supply of a fluid to the internal hollow space so that the pressure in the hollow space exceeds a pressure external to said one plug body to a level at which said at least one of said plug sections is blown apart.

2. Plug element according to claim 1, characterised in that said one plug body is designed to be crushed by the setting up of a differential pressure between the internal pressure of the plug body and the external pressure of the plug body which is equal to the internal pressure in the pipe, with the plug element comprising an axially moving, double acting piston which is fitted in a casing in a wall of the plug element in which the lower part of the piston has an area which is smaller than the upper part of the piston and when pressure from a pipe in which the plug element is fitted is applied to the upper largest area of the piston, the pressure in the lower part, which is in connection with the hollow space of said one plug body, will increase as a consequence of the smaller area of the lower side of the piston and said one plug body will now be blown apart from the inside as a consequence of the increased pressure difference between the inside of said one plug body and its outside.

3. Plug element according to claim 2 wherein said external pressure is a hydraulic pressure.

4. Plug element according to claim 1 characterised in that an activation system is built into said wall of said plug element to recognise pressure pulses in a pipe in which the plug element is fitted and when the correct signal has been picked up, opens a valve for pressure in to the piston or out from an accumulator, or the internal pressure in the pipe is released directly in to the hollow space whereby said plug body can have a sufficient pressure difference from the one side to the other side in the pipe to be blown apart.

5. Plug element according to claim 1 characterised in that the internal pressure which is required for said one plug body to be blown apart is provided by using an advance compressed pressure in the form of a gas in an accumulator, which is released into the hollow space of said one plug body with the help of a valve which opens for this when an opening signal is sent out.

6. Plug element according to claim 1 characterised in that said one plug body is fitted using high-pressure seals on both sides of the hollow space lying inside so that said one plug body is blown apart before a leakage occurs through the seal, and similarly, a casing and a piston are fitted with corresponding high-pressure seals to retain the pressure integrated until said one plug body breaks.

7. Plug element according to claim 1 characterised in that said one plug body is formed with an internal profile to withstand a high pressure from the outside but only a small pressure from the inside.

8. Plug element according to claim 1 characterised in that one of said plug sections is weaker than the other of said plug sections whereby said one plug section breaks before the other of said plug sections in response to the pressure in the hollow space exceeding a pressure external to said one plug body.

9. Plug element according to claim 1 characterised in that the internal pressure which is required to blow said one plug body apart can be provided by activating one or more small pyrotechnical charges which release enough gas to increase the pressure in the hollow space to the level required for said one plug body to be blown apart.

10. Plug element according to claim 1 characterised in that the internal pressure in said one plug body is provided by using several small pistons that are activated where these pistons also have area differences between the upper and the lower parts and the lower part is in connection with the hollow space in said one plug body.

11. Plug element according to claim 1 characterised in that said one plug body comprises an extra body placed between said at least two plug sections, said extra body forming a first hollow space with one of said plug sections and a second hollow space with the other of said hollow sections.

12. Plug element according to claim 1 further comprising a piston having a channel in connection with a boring in a casing when said piston has completed its stroke, with said boring and channel having the task of ensuring good liquid flow past a crushed plug section so that a remaining plug section will now experience the full differential pressure and the crushed plug section is easier to wash out.

13. Plug element according to claim 1 characterised in that said at least two plug sections have natural uneven surfaces in the opposite surfaces to define the hollow space.

14. Plug element according to claim 1 characterised in that more than two plug bodies are used where the hollow spaces between these be pressurised separately in that there is a seal between the different plug bodies so that the now different hollow spaces obtain a pressure integrated in relation to each other.

15. A plug body for seating in and across a pipe, said plug body comprising at least two abutting plug sections of disintegratable/crushable material defining an internal hollow space therebetween, each said plug section being crushable under a pressure in said hollow space exceeding an external pressure on said two plug sections.

16. A plug body as set forth in claim 15 wherein natural uneven surfaces in opposite surfaces of said abutting plug sections to define the hollow space.

* * * * *